US010815799B2

(12) United States Patent
Burdgick et al.

(10) Patent No.: US 10,815,799 B2
(45) Date of Patent: Oct. 27, 2020

(54) TURBINE BLADE WITH RADIAL SUPPORT, SHIM AND RELATED TURBINE ROTOR

(71) Applicant: General Electric Company, Schenectady, NY (US)

(72) Inventors: Steven Sebastian Burdgick, Schenectady, NY (US); John James Ligos, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 65 days.

(21) Appl. No.: 16/192,712

(22) Filed: Nov. 15, 2018

(65) Prior Publication Data

US 2020/0157954 A1 May 21, 2020

(51) Int. Cl.
*F01D 5/30* (2006.01)
*F01D 5/32* (2006.01)

(52) U.S. Cl.
CPC ..... *F01D 5/3007* (2013.01); *F01D 5/323* (2013.01); *F01D 5/326* (2013.01); *F05D 2220/31* (2013.01); *F05D 2260/30* (2013.01)

(58) Field of Classification Search
None
See application file for complete search history.

(56) References Cited

U.S. PATENT DOCUMENTS 3,572,970 A * 3/1971 Smuland ..... F01D 5/22 416/221
4,265,595 A * 5/1981 Bucy, Jr. ..... F01D 5/3007 416/220 R
4,451,205 A 5/1984 Honda et al.
4,711,007 A 12/1987 Conrad
5,236,309 A * 8/1993 Van Heusden ..... F01D 5/323 416/206
5,431,542 A * 7/1995 Weisse ..... F01D 5/323 416/219 R (Continued)

FOREIGN PATENT DOCUMENTS

GB 2115499 A 9/1983

OTHER PUBLICATIONS

International Search Report and Written Opinion for corresponding PCT Application Serial No. PCT/US2019/061591, dated Feb. 4, 2020.

*Primary Examiner* — Igor Kershteyn
*Assistant Examiner* — Juan G Flores
(74) *Attorney, Agent, or Firm* — Charlotte C. Wilson; James W. Pemrick

(57) ABSTRACT

A turbine blade has a first end, and an opposing second end. A base includes a dovetail for complementing a corresponding dovetail slot in a rotor. The dovetail has a body and a plurality of projections extend from the body in opposing directions. A tapered groove extends through the body from the first end to the second end, and has a tapered profile such that a first depth of the tapered groove near the first end is greater than a second depth of the tapered groove near the second end. The tapered profile gradually transitions from the first depth to the second depth. The tapered groove is open at a bottom surface of the body and is sized to engage a shim. The tapered groove includes a flat section near the first end or the second end, and the flat section has a constant depth.

20 Claims, 15 Drawing Sheets

(56) References Cited

U.S. PATENT DOCUMENTS

| | | | | |
|---|---|---|---|---|
| 6,065,938 | A * | 5/2000 | Bartsch | F01D 5/30<br>416/219 R |
| 9,909,429 | B2 * | 3/2018 | Cosby | F01D 5/141 |
| 2016/0186581 | A1 | 6/2016 | Dierksmeier et al. | |
| 2018/0142561 | A1 | 5/2018 | Burdgick et al. | |

* cited by examiner

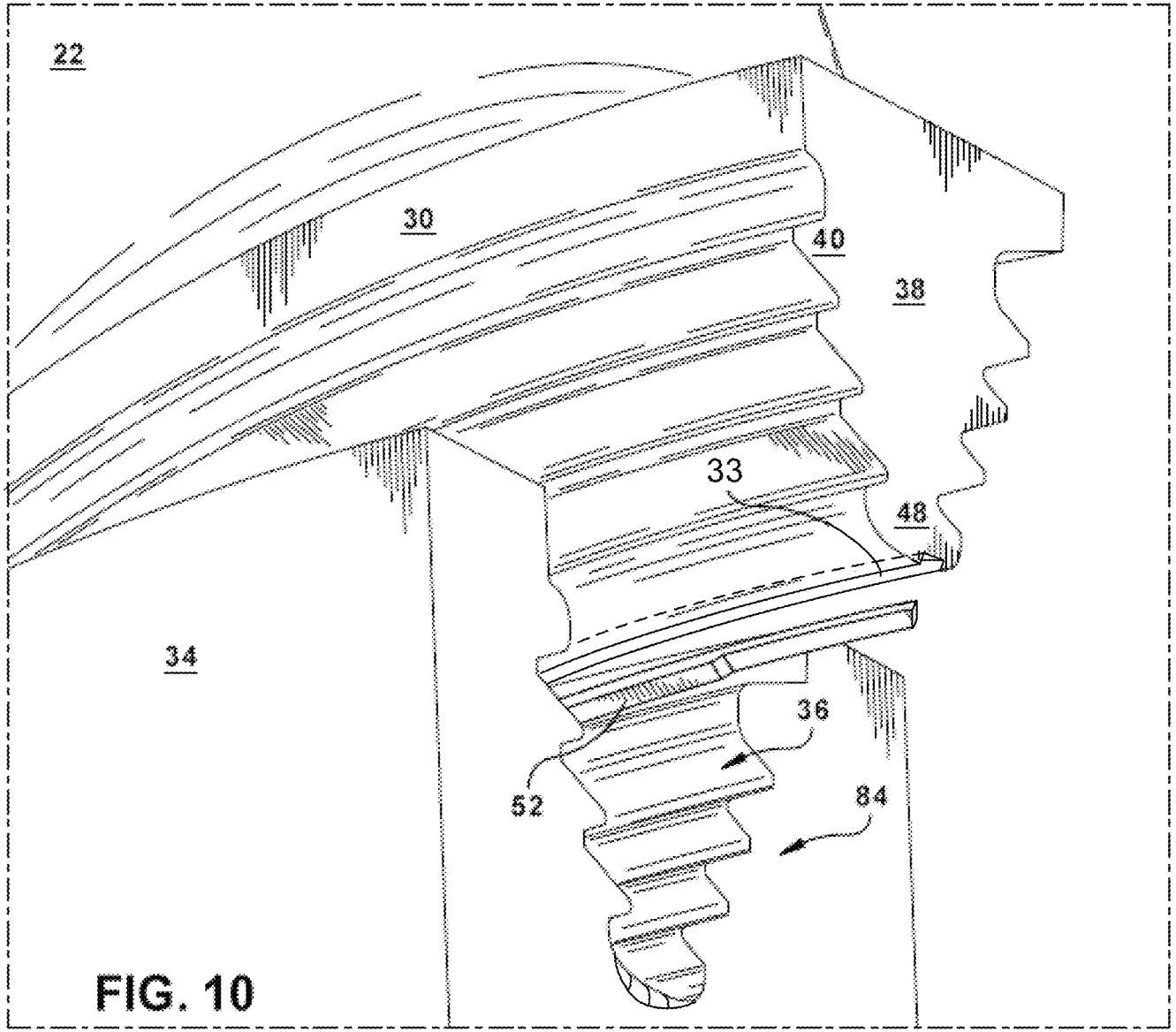
FIG. 10
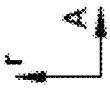

TURBINE BLADE WITH RADIAL SUPPORT, SHIM AND RELATED TURBINE ROTOR

CROSS-REFERENCE TO RELATED APPLICATIONS

This application is related to U.S. application Ser. No. 15/355,818 filed on Nov. 18, 2016, and U.S. application Ser. No. 15/791,469 filed on Oct. 24, 2017.

FIELD OF THE INVENTION

The subject matter disclosed herein relates to turbomachines. Specifically, the subject matter disclosed herein relates to support of blades in turbomachines, e.g., steam turbines and/or gas turbines.

BACKGROUND OF THE INVENTION

Steam turbines include static nozzle assemblies that direct flow of a working fluid into turbine blades (also referred to as buckets) connected to a rotating rotor. The nozzle construction (including a plurality of nozzles, or "airfoils") is sometimes referred to as a "diaphragm" or "nozzle assembly stage." Blades, such as those in the last stage of the turbine, have a base with a dovetail that are sized to fit within corresponding dovetail slots in the rotor. Many last stage blades are of significant length and have a substantial weight. During low speed (also known as, turning gear) operation, the blades have the ability to move within the rotor dovetails where they are retained. This undesirable movement can cause significant wear on the blade and/or rotor dovetail slots. This wear on the blades and dovetail slots can cause outages, require repairs, and result in undesirable costs.

During rotor assembly, it is required to have some movement ("fanning") of the blades to facilitate assembly of the blades. The blades have outer cover ends and these typically have interlocking features. The blades must pass each other during assembly of the previous blade during row assembly. The blades may also overlap airfoils such that assembly of the last blades in the row may be difficult, if not impossible, to assemble if adequate movement does not exist.

BRIEF DESCRIPTION OF THE INVENTION

Various aspects include a turbine blade having a blade or airfoil having a first end, and a second end opposite the first end. A tip is located at an outer radial portion of the blade. A base is at an inner radial portion of the blade, and the base includes a dovetail for complementing a corresponding dovetail slot in a turbine rotor. The dovetail has a body and a plurality of projections extend from the body in opposing directions for complementing a plurality of recesses in the corresponding dovetail slot. A tapered groove extends through the body from the first end to the second end. The tapered groove has a tapered profile such that a first depth of the tapered groove near the first end is greater than a second depth of the tapered groove near the second end. The tapered profile gradually transitions from the first depth to the second depth. The tapered groove is open at a bottom surface of the body and is sized to engage a shim. The tapered groove includes a flat section near the first end or the second end, and the flat section has a constant depth.

A second aspect of the disclosure includes a shim for retaining a turbine blade. The shim has a main body having a first thickness measured between an upper surface and a lower surface, and a second thickness measured between the upper surface and the lower surface. The first thickness is located near a first end of the shim and the second thickness is located near a second end of the shim. The first end is generally opposing the second end, and the first thickness is greater than the second thickness. A thinned region extends from the main body and has a third thickness measured between the upper surface and a thinned, lower surface. The thinned region is located at the first end, and a tapered region connects the main body to the thinned region.

A third aspect of the disclosure includes a turbine rotor having a rotor body having a plurality of dovetail slots including a plurality of recesses. A turbine blade is within one of the plurality of dovetail slots. The turbine blade has a blade having a first end, and a second end opposite the first end. A tip is at an outer radial portion of the blade. A base is at an inner radial portion of the blade, and the base includes a dovetail for complementing a corresponding dovetail slot in the turbine rotor. The dovetail has a body, and a plurality of projections extend from the body in opposing directions for complementing a plurality of recesses in the corresponding dovetail slot. A tapered groove extends through the body from the first end to the second end. The tapered groove has a tapered profile such that a first depth of the tapered groove near the first end is greater than a second depth of the tapered groove near the second end. The tapered profile gradually transitions from the first depth to the second depth. The tapered groove is open at a bottom surface of the body and sized to engage a shim. The tapered groove includes a flat section near the first end or the second end, and the flat section has a constant depth.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which:

FIG. 10 shows a blow-out schematic perspective view of a steam turbine bucket, a rotor, and a shim according to various embodiments of the disclosure.

Figure 1:
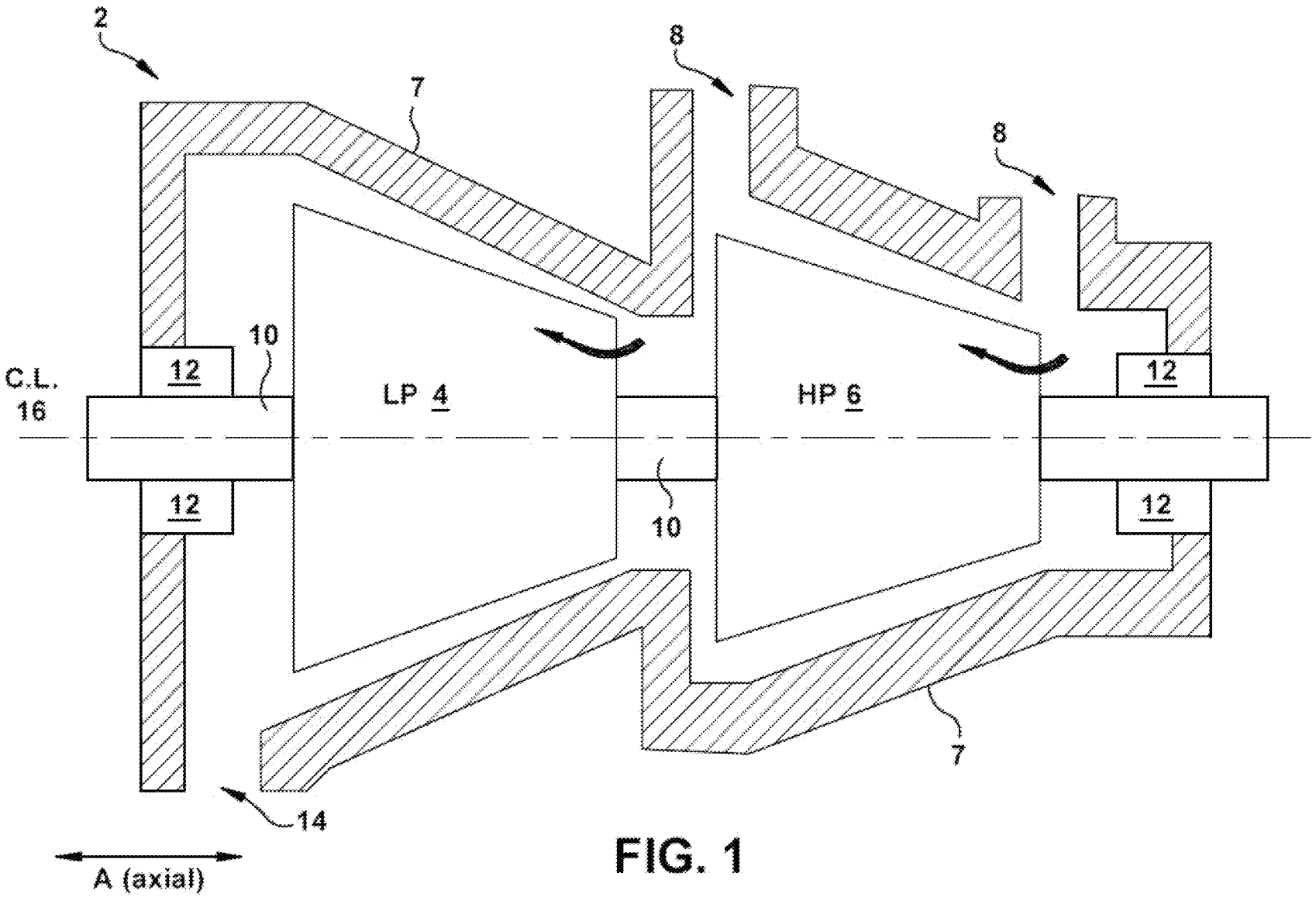
FIG. 1 shows a partial cross-sectional schematic view of a turbomachine, according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The subject matter disclosed herein relates to turbomachines. Specifically, the subject matter disclosed herein relates to supporting blades in turbomachines, e.g., steam turbines.

As denoted in these Figures, the "A" axis represents axial orientation (along the axis of the turbine rotor, sometimes referred to as the turbine centerline). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. The phrase "radially inward" is in a direction facing the A-axis or axis of the turbine rotor, and "radially outward" is in a direction opposite to radially inward, or in a direction away from the A-axis. Additionally, the terms "circumferential" and/or "circumferentially" refer to the relative position/direction of objects along a circumference (c) which surrounds axis A but does not intersect the axis A at any location. Identically labeled elements in the Figures depict substantially similar (e.g., identical) components.

In contrast to conventional components and approaches for retaining blades in steam turbines, various aspects of the disclosure provide for a steam turbine blade, and a corresponding retaining shim, which enhance the ease of installation and/or removal of blades from steam turbine rotors, as well as improve the retention of those blades within the rotor. Conventional systems for retaining blades within rotors utilize combinations of shims, springs and tight-fitting dovetail connections. These systems can occupy a significant amount of space, be difficult to install, and/or cause stresses on components such as the blade dovetail or rotor dovetail due to their tight fit and limited flexibility. The components disclosed according to various embodiments described herein can be installed with much less effort than conventional configurations, and provide for enhanced retention during operation.

Turning to FIG. 1, a partial cross-sectional schematic view of steam turbine 2 (e.g., a high-pressure/intermediate-pressure steam turbine) is shown. Steam turbine 2 may include, for example, a low pressure (LP) section 4 and a high pressure (HP) section 6 (it is understood that either LP section 4 or HP section 6 can include an intermediate pressure (IP) section, as is known in the art). The LP section 4 and HP section 6 are at least partially encased in casing 7. Steam may enter the HP section 6 and LP section 4 via one or more inlets 8 in casing 7, and flow axially downstream from the inlet(s) 8. In some embodiments, HP section 6 and LP section 4 are joined by a common shaft 10, which may contact bearings 12, allowing for rotation of shaft 10, as working fluid (steam) forces rotation of the blades within each of LP section 4 and HP section 6. After performing mechanical work on the blades within LP section 4 and HP section 6, working fluid (e.g., steam) may exit through outlet 14 in casing 7. The center line (CL) 16 of HP section 6 and LP section 4 is shown as a reference point. Both LP section 4 and HP section 6 can include diaphragm assemblies, which are contained within segments of casing 7.

Figure 2:
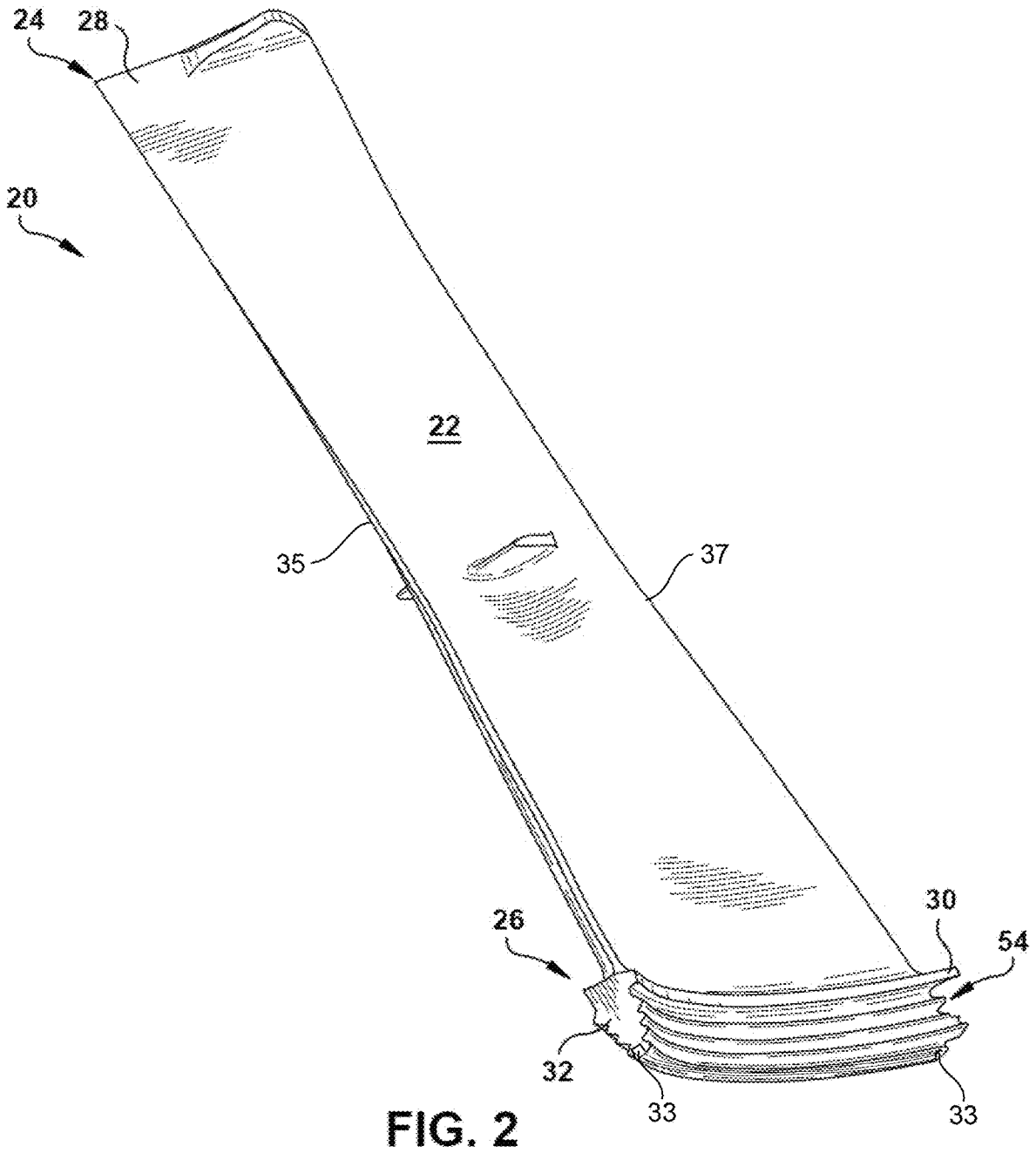
FIG. 2 shows a schematic perspective view of a steam turbine bucket, according to various embodiments of the disclosure.
Figure 3:
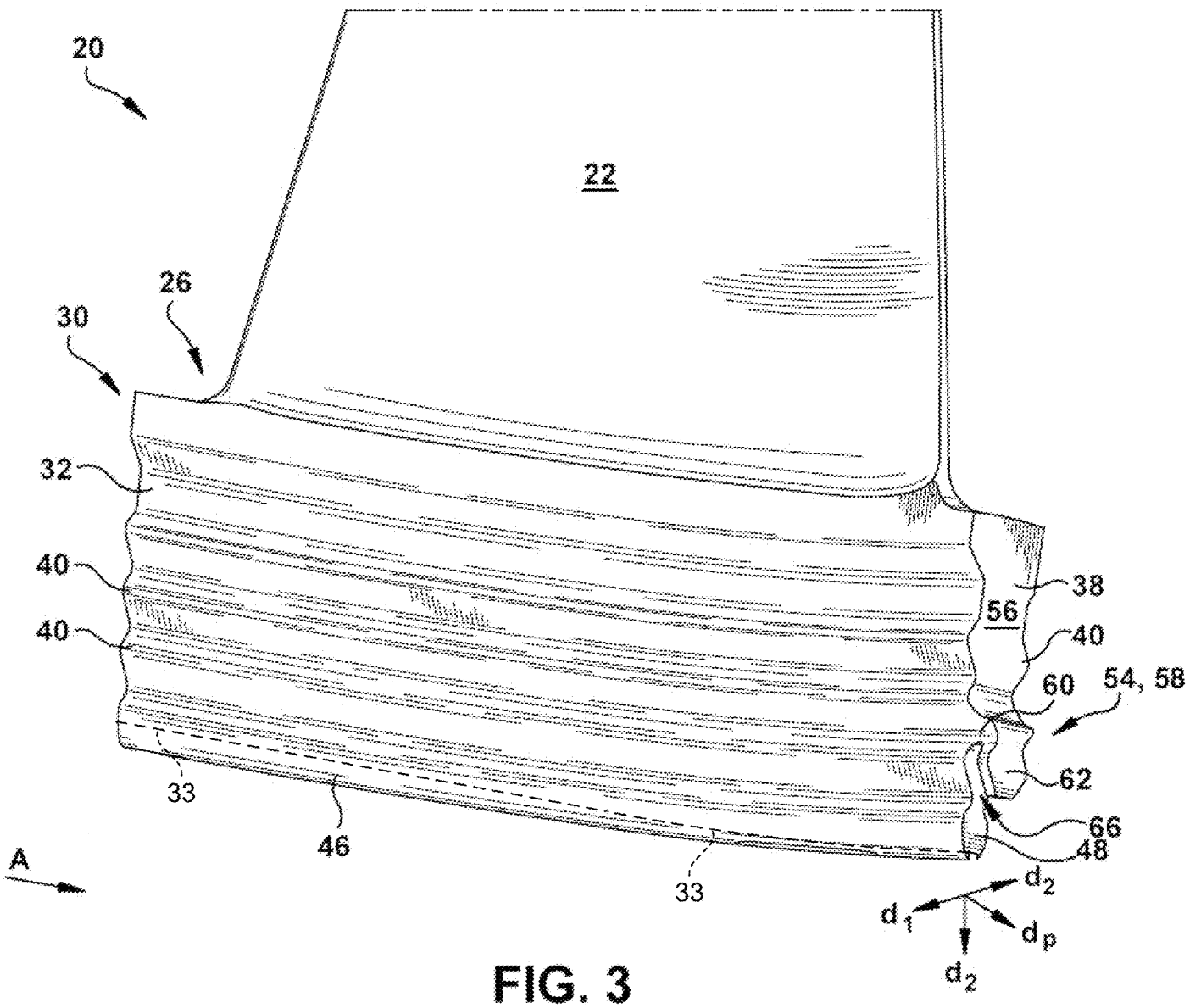
FIG. 3 shows a close-up view of the steam turbine bucket of FIG. 2.

FIG. 2 shows a schematic perspective view of a steam turbine blade 20 (e.g., within LP section 4) according to various embodiments of the disclosure. FIG. 3 shows a close-up perspective view of a portion of the steam turbine blade 20. As shown, steam turbine blade (or bucket) 20 can include a blade or airfoil 22 having a radially outer first end 24, and a radially inner second end 26 opposite first end 24. First end 24 of blade 22 can include a tip 28, which may be coupled to a shroud (not shown) in some embodiments. At second end 26 of blade 22 is a base 30, which includes a dovetail 32 for engaging with and complementing a corresponding dovetail slot in a rotor (FIG. 4).

Figure 4:
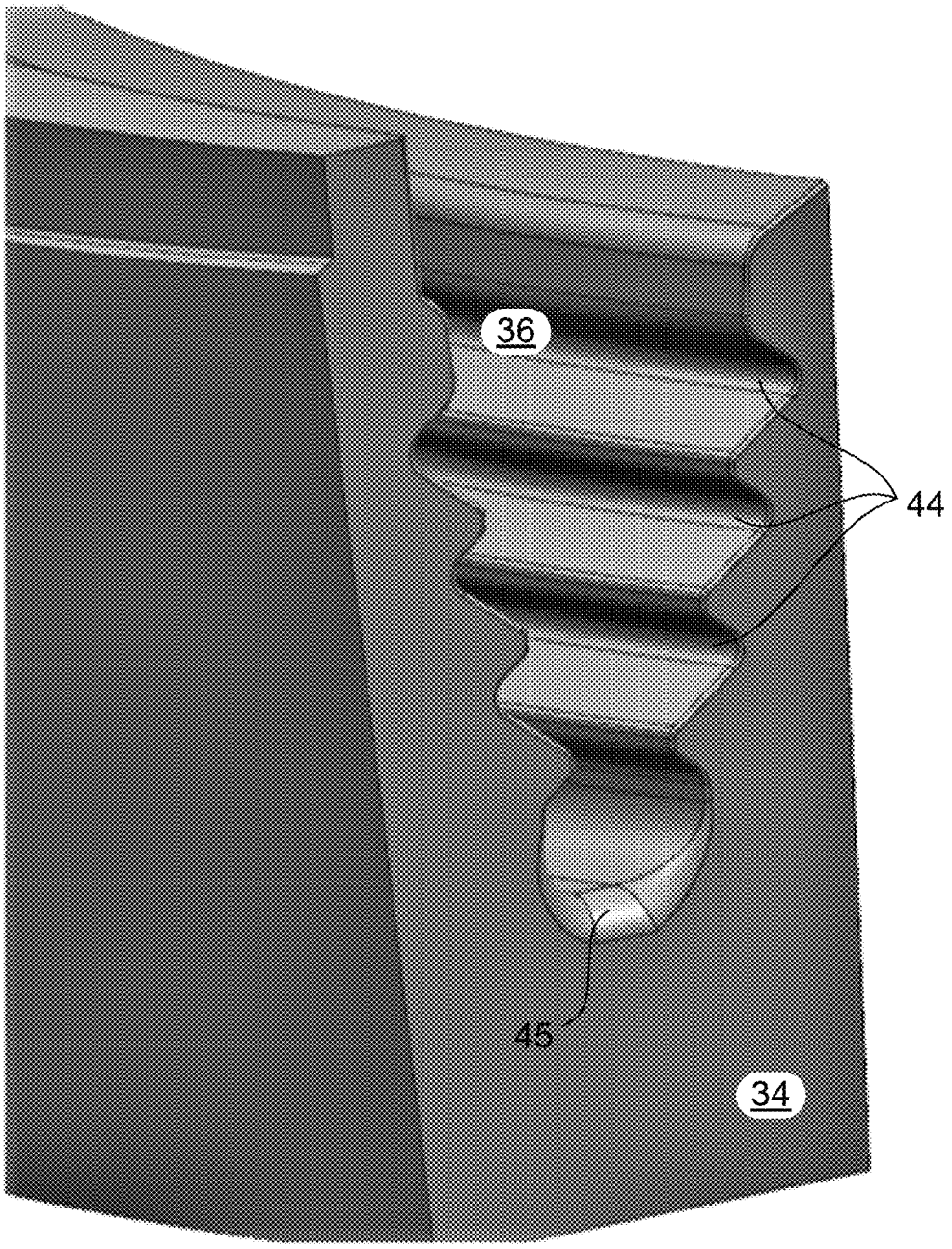
FIG. 4 shows a close-up schematic perspective view of a steam turbine rotor.
Figure 14:
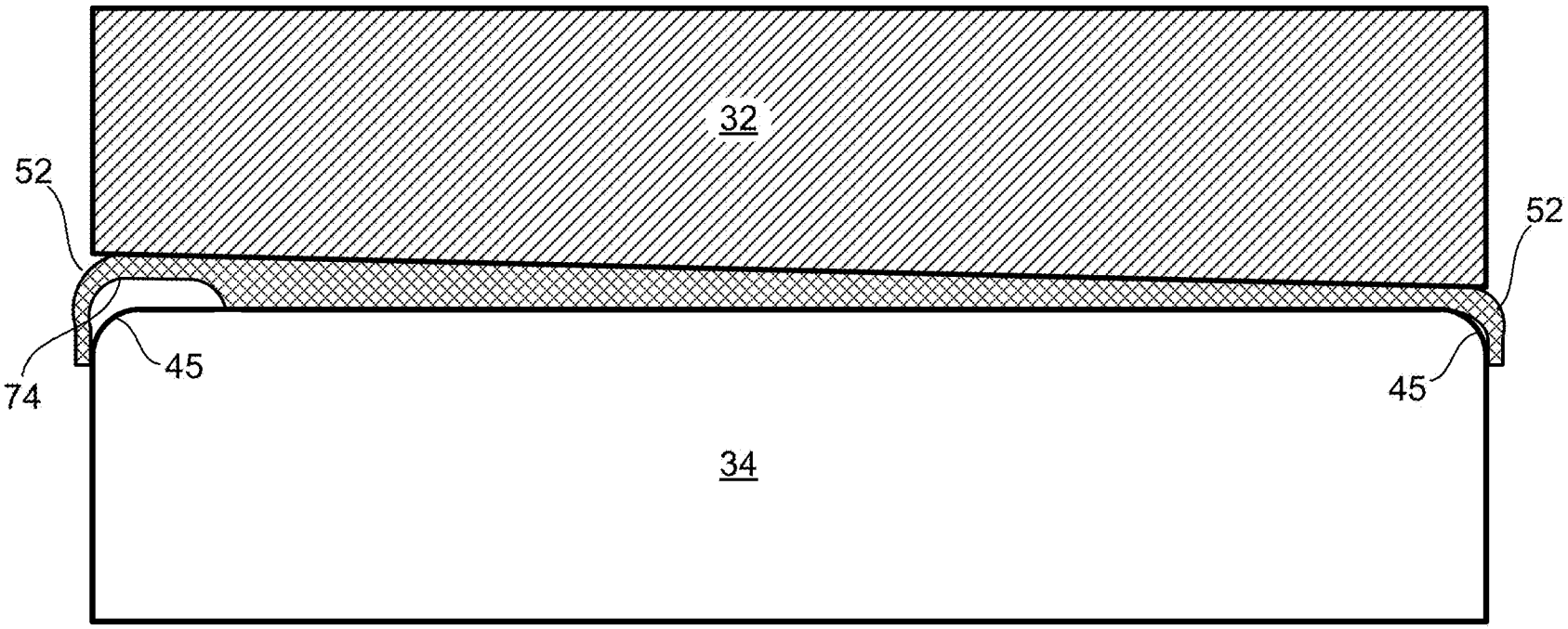
FIG. 14 illustrates a simplified cross-sectional view of the shim placed in the tapered groove and the blade attached to the rotor or wheel, according to embodiments of the disclosure.
Figure 15:
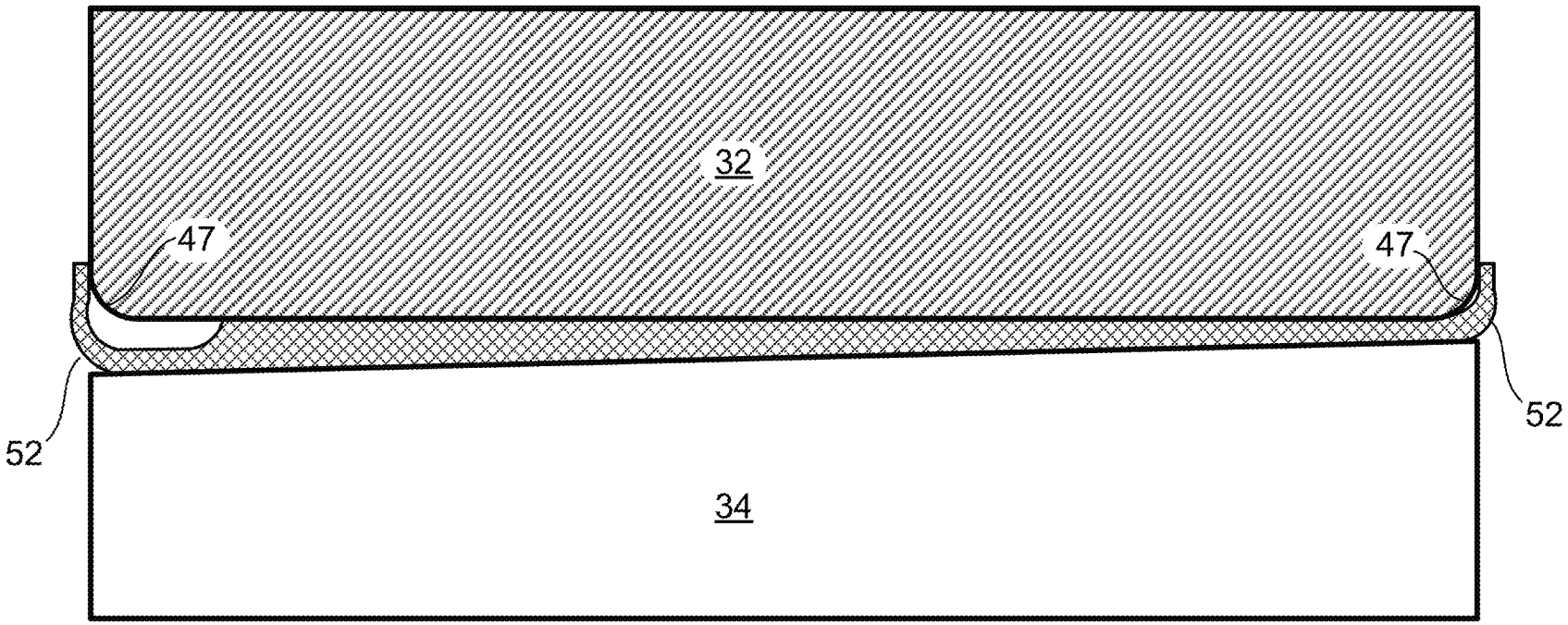
FIG. 15 illustrates a simplified cross-sectional view of the shim placed in between the blade and the rotor or wheel, according to embodiments of the disclosure.

FIG. 4 shows a close-up perspective view of a portion of a rotor 34 (e.g., a steam turbine rotor) including a dovetail slot 36 for coupling with dovetail 32 of blade 20. In FIG. 2, a tapered groove 33 extends along the bottom (radially inner) portion of the dovetail 32. The blade 20 includes a first end 35 and a second end 37. The first end 35 may be a leading edge of the blade and the second end 37 a trailing edge of the blade, or vice-versa. The tapered groove 33 is deeper (i.e., extends radially deeper into the dovetail) near the first end, and the depth of the groove 33 gradually reduces at it extends to the second end 37. As one non-limiting example only, the depth of the tapered groove 33 near the first end 35 may be about 0.30 inches and the depth of the groove 33 near the second end 37 may be about 0.12 inches. A blended region 45 is located on the axially facing and opposing surfaces (or upstream and downstream facing surfaces) of the rotor 34 or wheel at the radially inner portion of slot 36. The blended region 45 has a radiused surface and it assures a proper bend radius of the wedge/shim such that no cracking will occur in the wedge/shim when it is bent over the rotor 34 (as shown in FIG. 14) or blade dovetail (as shown in FIG. 15).

Figure 5:
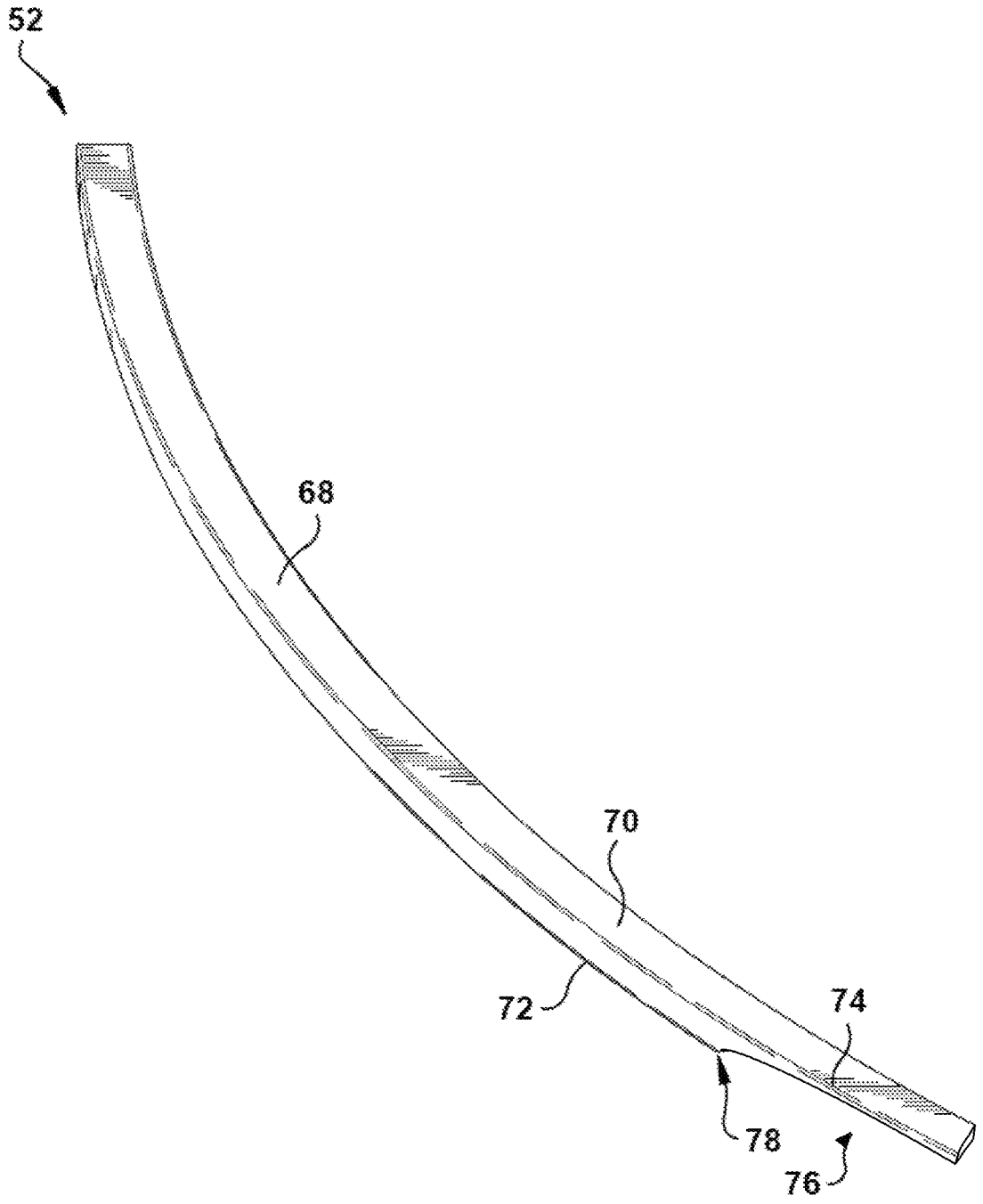
FIG. 5 shows a schematic perspective view of a shim, according to various embodiments of the disclosure.
Figure 6:
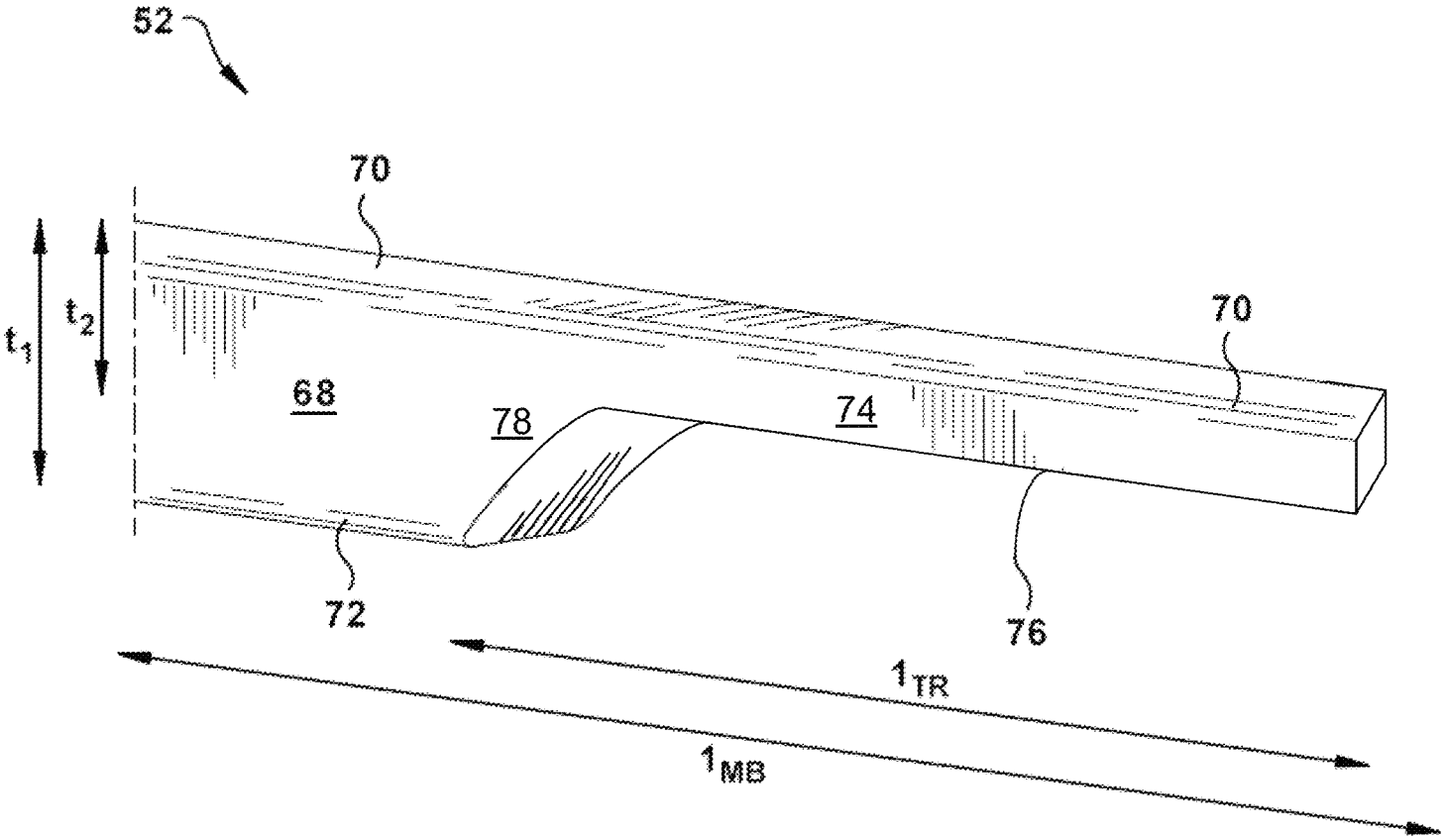
FIG. 6 shows a close-up view of the shim of FIG. 5.

Returning to FIG. 3, in contrast to conventional steam turbine blades, blade 20 can include dovetail 32, which includes: a body 38, a plurality of projections 40 extending from the body in opposing directions ($d_1$, $d_2$), and a tapered groove 33 extending through body 38 along the length of the dovetail. The plurality of projections 40 are sized to complement a plurality of recesses 44 in the corresponding dovetail slot 36 (FIG. 4). In various embodiments, tapered groove 33 is open at a bottom surface 46 of body 38, and is sized to engage a shim (FIG. 5). Tapered groove 33 extends entirely through body 38 and is open at the bottom thereof. In various embodiments, body 38 includes a lowermost bulbous section 48 for complementing one of the plurality of recesses 44 in dovetail slot 36 (FIG. 4). A shim 52 is shown schematically in FIG. 5, and in a close-up perspective in FIG. 6, and further described herein.

Figure 7:
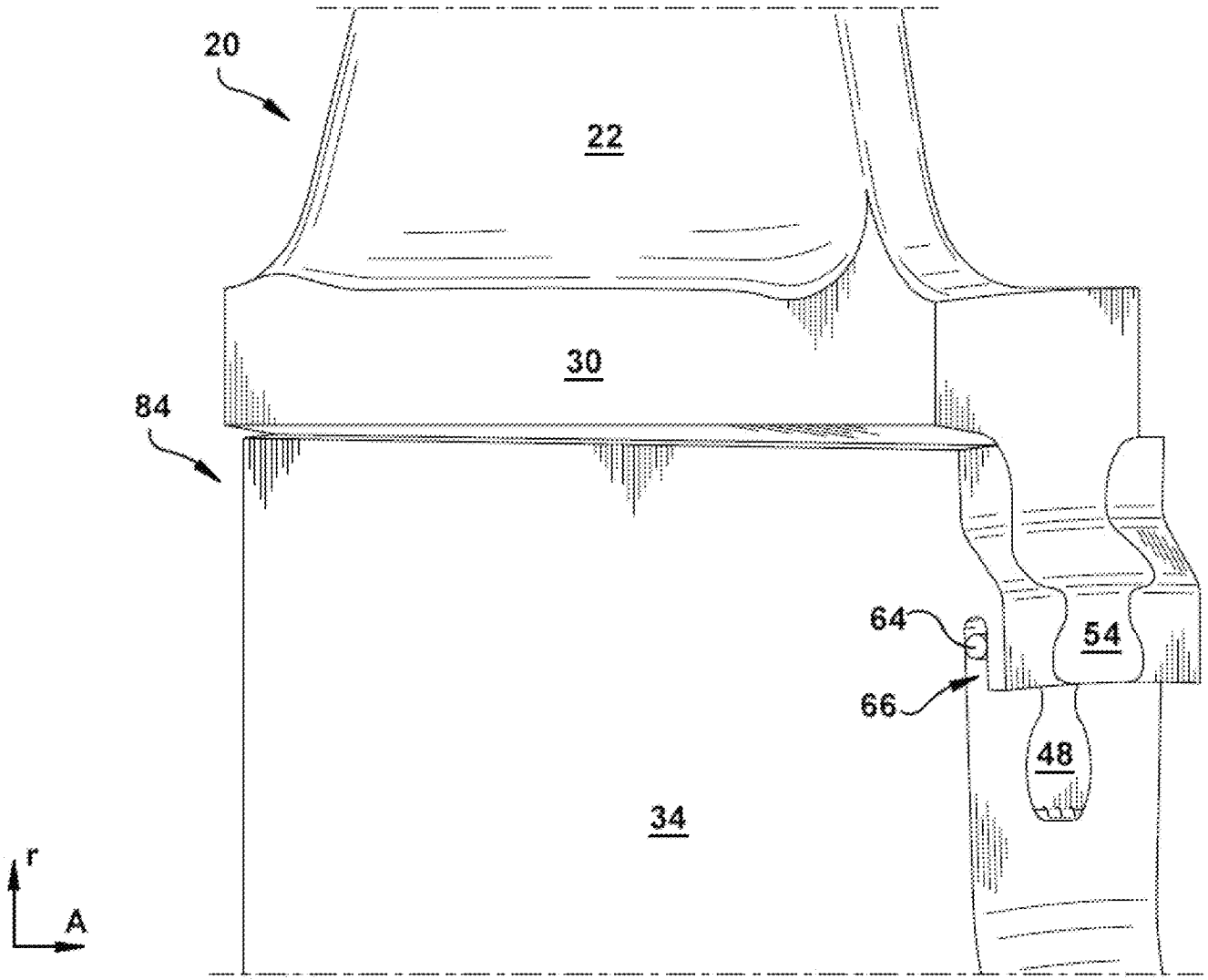
FIG. 7 shows a schematic perspective view of a portion of a steam turbine bucket, rotor and retaining member according to various embodiments of the disclosure.
Figure 8:
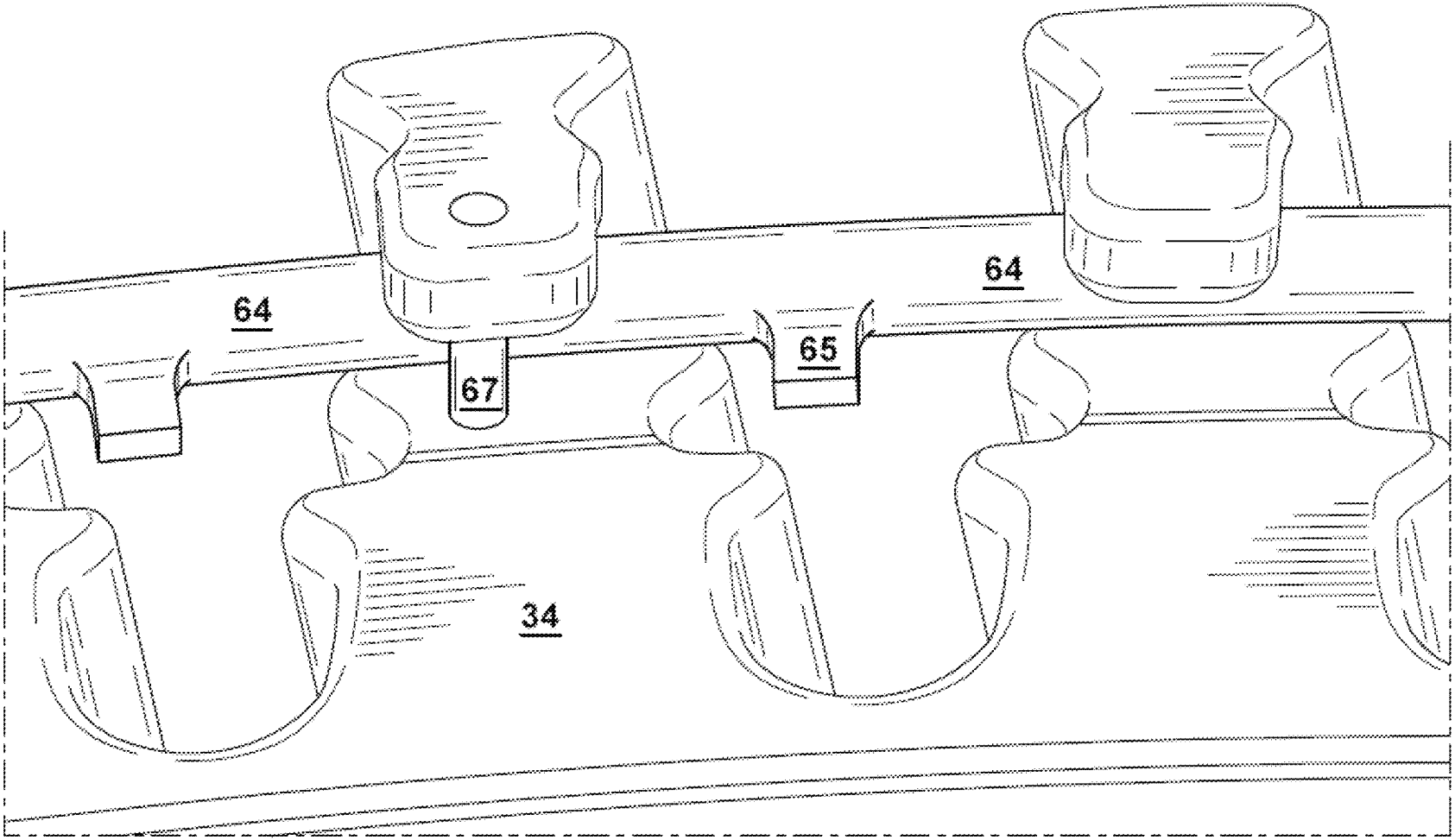
FIG. 8 shows a schematic perspective view of a steam turbine rotor and retaining member, according to various embodiments of the disclosure.

Blade 20 can further include an axial retention feature 54 extending from a side 56 of body 38 in a direction ($d_p$) perpendicular from the plurality of projections 40. That is, axial retention feature 54 can extend from side 56 of body 38 in direction ($d_p$) that is perpendicular to the opposing directions ($d_1$, $d_2$). In some cases, axial retention feature 54 can include a hook 58, having a first member 60 extending from body 38 in a first direction (direction $d_p$), and a second member 62 extending from first member 60 in a second, distinct direction ($d_{h2}$). In various embodiments, second, distinct direction ($d_{h2}$) is perpendicular to first direction ($d_p$). As described further herein, axial retention feature 54 is configured to aid in axially retaining blade 20 in rotor 34 (in axial direction, A), via an axial retention member 64 (FIG. 7, FIG. 8). In various embodiments, axial retention feature 54 defines a space 66 adjacent body 38 that is sized to engage the axial retention member 64. Space 66 may be located between axial retention feature 54 and side 56 of body 38 in some embodiments. FIG. 7 shows a schematic cut-away depiction of blade 20 engaged with rotor 34, and portion of an axial retention member 64 within space 66 for axially retaining blade 20 within rotor 34. FIG. 8 shows a perspective radially outwardly facing view of axial retention member 64 positioned relative to rotor 34, excluding blade(s) 20. In some cases, axial retention member 64 further includes an anti-rotation tab 65 (FIG. 8) for engaging hook 58 (FIG. 3) and preventing rotation of axial retention member 64 within space 66 (FIG. 3, FIG. 7). Additionally, an anti-rotation pin 67 (FIG. 8) can be coupled to rotor 34 to prevent radial movement of axial retention member 64 within space 66.

Returning to FIG. 5 and FIG. 6, shim 52 is shown in greater detail. In various embodiments, shim 52 is sized to engage tapered groove 33 in blade 20 and help to retain blade 20 within dovetail slot 36 (FIG. 4). In some cases, shim 52 includes a main body 68 having a first thickness ($t_1$) measured between an upper surface 70 and a lower surface 72 of main body 68 (where upper and lower surfaces 70, 72 coincide with radially inner and radially outer surfaces, respectively, when shim 52 is loaded between blade and rotor 34 in dovetail slot 36). Extending from main body 68 is a thinned region 74, having a second thickness ($t_2$) measured between upper surface 70 (which is continuous between main body 68 and thinned region 74) and a thinned, lower surface 76. In some cases, the second thickness ($t_2$) is between approximately (e.g., +/−1-5%) 5 percent to approximately 70 percent of the first thickness ($t_1$). Connecting main body 68 and thinned region 74 is a first tapered region 78, which is tapered inward from main body 68 to thinned region 74.

As described herein, shim 52 is configured to fit in tapered groove 33 and between dovetail 32 of blade 20, and dovetail slot 36 of rotor 34, and aid in retaining blade 20 within rotor 34. Further, in various embodiments, thinned region 74 enhances ease of installation and removal of shim 52 within the tight clearances of the steam turbine. That is, thinned region 74 can permit flexion of shim 52 or bending over of an end of the shim to lock the shim to rotor 34. The thinned region 74 is preferably located on the thicker end of the shim, as the thicker end would be more difficult to bend over than the opposing thinner end. The section 74 is thinned to assure proper bend to thickness ratio such that cold working will not result in cracking or a high residual stressed area. The reduced thickness facilitates bending over a portion of the shim to lock it to the rotor, and the opposing end portion near the thin end can also be bent over in a similar manner to lock the shim to rotor 34. An important reason the bend-over is required at the thick end is because during operation the radial gap between the rotor dovetail bottom and the blade dovetail bottom can get larger due to mechanical growth. This radial gap would allow the wedge or shim to move towards the thin end during operation and then during shut down the radial gap would return to normal height. As the wedge/shim may have move forward and filled the larger gap there would be no room during shutdown for the blade to return to a non-stressed state. The radial gap being filled would result in excessive compression of the wedge/shim such that stresses could be beyond yield and/or disassembly of the wedge and it would be virtually impossible to remove the wedge/shim due to extremely high compression loading. It is understood that shim 52 can be inserted in either a forward or aft direction into slot 84, depending upon clearances and desired installation techniques. In various embodiments, thinned region 74 can have a length ($l_{TR}$) equal to approximately one-quarter of a length ($l_{MB}$) of main body 68, or one-eighth of a length of the main body, or three-sixteenths of a length of the main body, or between about 10% and about 25% of the length of the main body.

Figure 9:
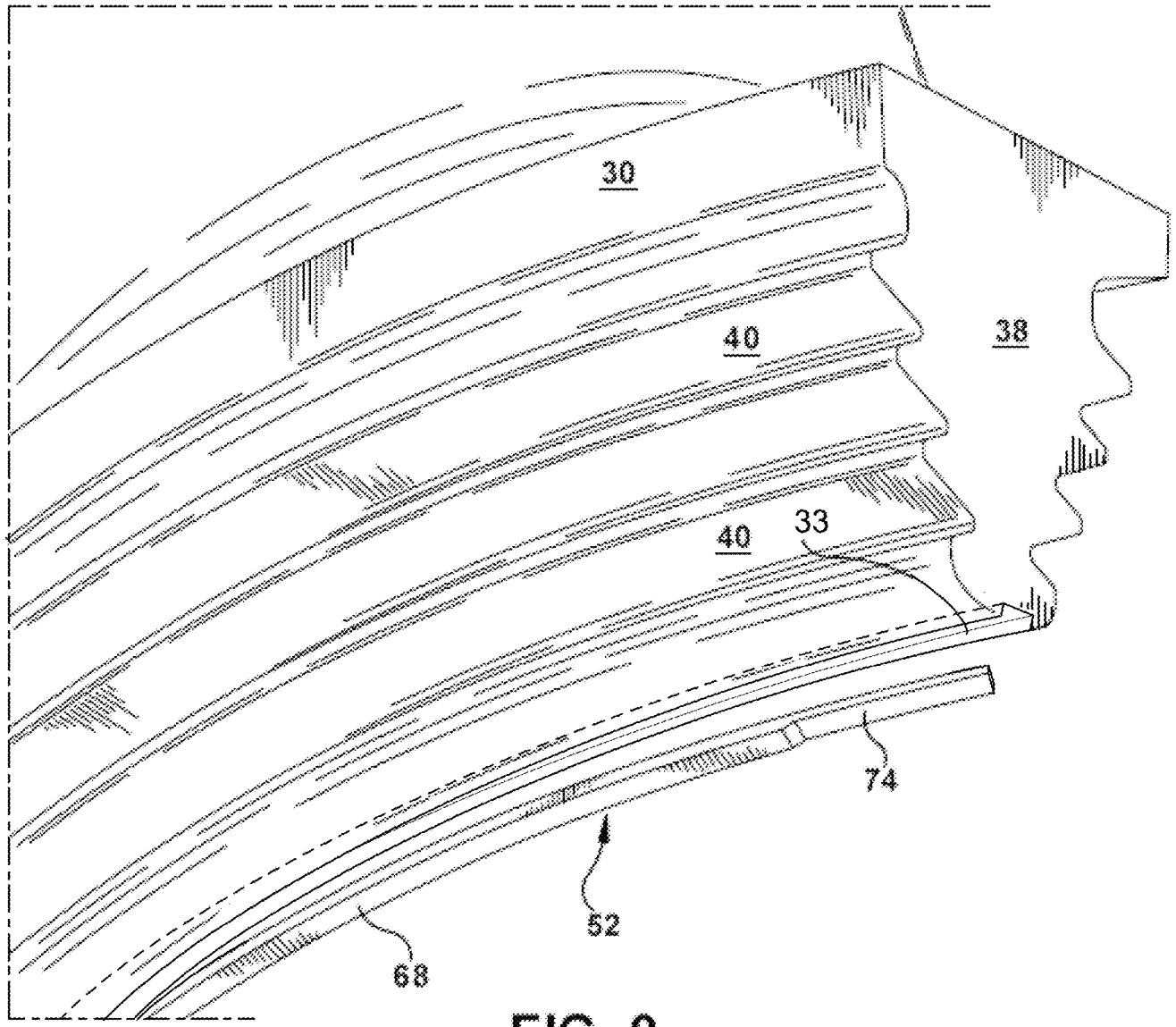
FIG. 9 shows a blow-out schematic perspective view of a steam turbine bucket and a shim, according to various embodiments of the disclosure.

FIGS. 9 and 10 illustrate perspective blown-out views of blade 20, rotor 34 (FIG. 10), and shim 52. FIG. 4 also shows a section of rotor 34 including a plurality of dovetail slots 36, as noted herein. In various aspects of the disclosure, a rotor 34 includes the plurality of dovetail slots 36, and at least one blade 20 within one of the plurality of dovetail slots 36. In some cases, an entire stage of a rotor 34 is assembled using blade(s) 20, or multiple stages of rotor 34 are assembled using blade(s) 20. As can be seen in FIGS. 9 and 10, tapered groove 33 is sized to complement shim 52, and fit between dovetail 32 of blade 20 and dovetail slot 36 of rotor 34.

Figure 11:
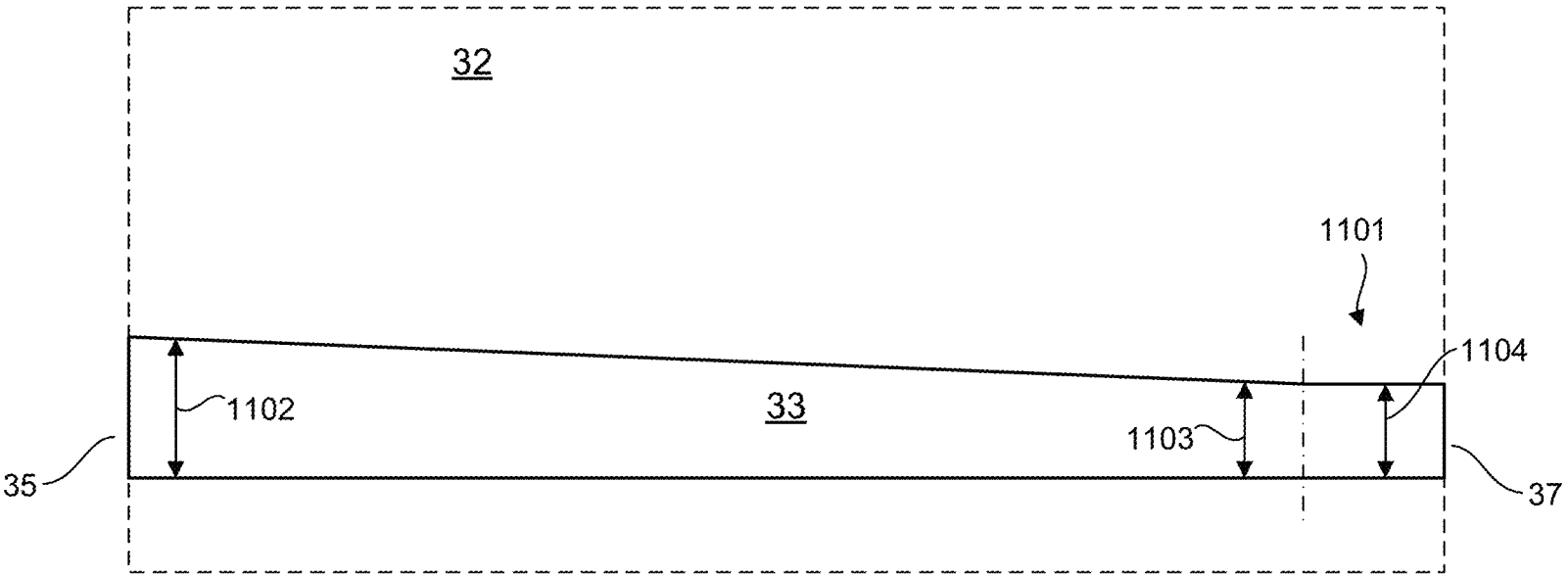
FIG. 11 illustrates a simplified cross-sectional view of the tapered groove, according to various embodiments of the disclosure.

FIG. 11 illustrates a simplified cross-sectional view of tapered groove 33, according to various embodiments. The tapered groove 33 may include a flat section 1101 near the first end 35 or the second end 37 (as shown), where the flat section 1101 has a constant depth (i.e., it is not tapered). For example, the first end 35 may be a leading edge of the blade, and the second end 37 may be the trailing edge of the blade. The depth 1102 of the tapered groove 33 at the deep end (left side of FIG. 11) is greater than the depth 1103 (and depth 1104) near the opposing end (right side of FIG. 11). The flat section 1101 has a constant depth 1104 across its length. The length of flat section 1101 may be about 3% to about 20% of the entire length of tapered groove 33. The flat section 1101 facilitates disassembly/removal of the shim 52 after turbine operation, and may also enable avoiding the use of a cut-off tool in the field during disassembly. The flat section allows for a larger gap at the thin end of the wedge. This gap accommodates bending the thin end bend-over back to near-straight and then being able to tap the wedge towards the thick end. Without this additional gap area the bending back of the end would form a "mushroomed" bend area and would not allow for easy disengagement of the thin end. Additionally, the flat section becomes the tertiary datum for machining and inspection of the blade as using the groove taper would not be prudent or robust.

Figure 12:
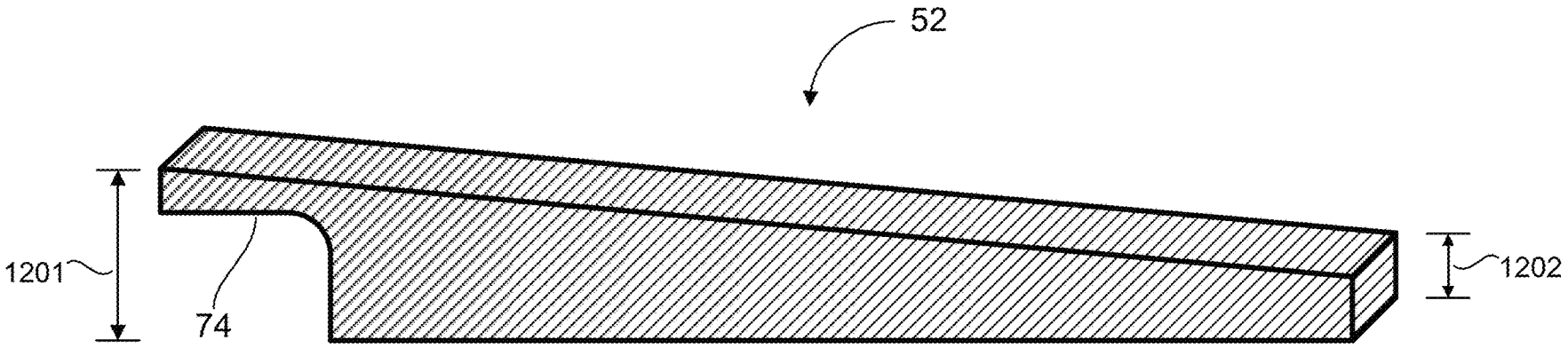
FIG. 12 illustrates a simplified, cross-sectional view of the shim, according to various embodiments of the disclosure.

FIG. 12 illustrates a simplified, cross-sectional view of shim 52. The shim 52 includes a thick end and an opposing thin end, and the overall thickness gradually transitions between opposing ends. The thinned region 74 is a region of reduced thickness that enables the shim to be bent over the rotor or wheel to lock the shim in place. This is particularly effective when both ends of the shim are bent over the wheel/rotor, as the shim is prevented from moving in an axial direction (with respect to the turbine). For example, a first end of the shim 52 may have a first height 1201, and an opposing second end of the shim may have a second height 1202, where the first height is greater than the second height. The intermediate heights of the shim 52 gradually transition from the first height to the second height.

Blade 20 and/or shim 52 (FIGS. 2-12) may be formed in a number of ways. In one embodiment, blade 20 and/or shim 52 (FIGS. 2-12) may be formed by casting, forging, welding and/or machining. In one embodiment, however, additive manufacturing is particularly suited for manufacturing blade 20 and/or shim 52 (FIGS. 2-12). As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic, much of which is cut away and discarded, the only material used in additive manufacturing is what is required to shape the part. Additive manufacturing processes may include but are not limited to: 3D printing, rapid prototyping (RP), direct digital manufacturing (DDM), selective laser melting (SLM) and direct metal laser melting (DMLM). In the current setting, DMLM has been found advantageous.

Figure 13:
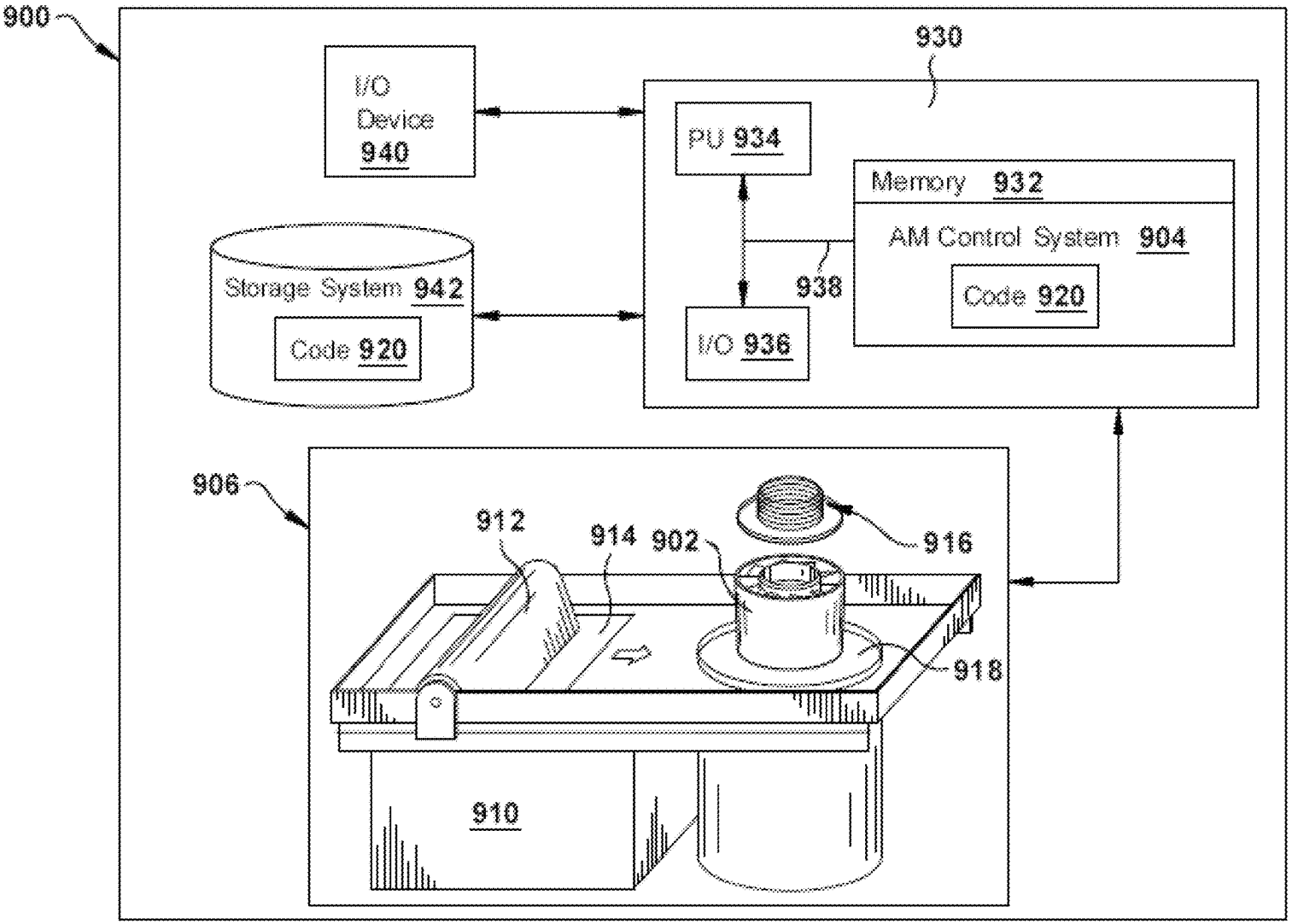
FIG. 13 shows a block diagram of an additive manufacturing process including a non-transitory computer readable storage medium storing code representative of a shim and/or a steam turbine bucket, according to embodiments of the disclosure.

To illustrate an example of an additive manufacturing process, FIG. 13 shows a schematic/block view of an illustrative computerized additive manufacturing system 900 for generating an object 902. In this example, system 900 is arranged for DMLM. It is understood that the general teachings of the disclosure are equally applicable to other forms of additive manufacturing. Object 902 is illustrated as a double walled turbine element; however, it is understood that the additive manufacturing process can be readily adapted to manufacture blade 20 and/or shim 52 (FIGS. 2-12). AM system 900 generally includes a computerized additive manufacturing (AM) control system 904 and an AM printer 906. AM system 900, as will be described, executes code 920 that includes a set of computer-executable instructions defining blade 20 and/or shim 52 (FIGS. 2-12) to physically generate the object using AM printer 906. Each AM process may use different raw materials in the form of, for example, fine-grain powder, liquid (e.g., polymers), sheet, etc., a stock of which may be held in a chamber 910 of AM printer 906. In the instant case, blade 20 and/or shim 52 (FIGS. 2-12) may be made of plastic/polymers or similar materials. As illustrated, an applicator 912 may create a thin layer of raw material 914 spread out as the blank canvas from which each successive slice of the final object will be created. In other cases, applicator 912 may directly apply or print the next layer onto a previous layer as defined by code 920, e.g., where the material is a polymer. In the example shown, a laser or electron beam 916 fuses particles for each slice, as defined by code 920, but this may not be necessary where a quick setting liquid plastic/polymer is employed. Various parts of AM printer 906 may move to accommodate the addition of each new layer, e.g., a build platform 918 may lower and/or chamber 910 and/or applicator 912 may rise after each layer.

AM control system 904 is shown implemented on computer 930 as computer program code. To this extent, computer 930 is shown including a memory 932, a processor 934, an input/output (I/O) interface 936, and a bus 938. Further, computer 930 is shown in communication with an external I/O device/resource 940 and a storage system 942. In general, processor 934 executes computer program code, such as AM control system 904, that is stored in memory 932 and/or storage system 942 under instructions from code 920 representative of blade 20 and/or shim 52 (FIGS. 2-12), described herein. While executing computer program code, processor 934 can read and/or write data to/from memory 932, storage system 942, I/O device 940 and/or AM printer 906. Bus 938 provides a communication link between each of the components in computer 930, and I/O device 940 can comprise any device that enables a user to interact with computer 940 (e.g., keyboard, pointing device, display, etc.). Computer 930 is only representative of various possible combinations of hardware and software. For example, processor 934 may comprise a single processing unit, or be distributed across one or more processing units in one or more locations, e.g., on a client and server. Similarly, memory 932 and/or storage system 942 may reside at one or more physical locations. Memory 932 and/or storage system 942 can comprise any combination of various types of non-transitory computer readable storage medium including magnetic media, optical media, random access memory (RAM), read only memory (ROM), etc. Computer 930 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 932, storage system 942, etc.) storing code 920 representative of blade 20 and/or shim 52 (FIGS. 2-12). As noted, code 920 includes a set of computer-executable instructions defining outer electrode that can be used to physically generate the tip, upon execution of the code by system 900. For example, code 920 may include a precisely defined 3D model of outer electrode and can be generated from any of a large variety of well-known computer aided design (CAD) software systems such as AutoCAD®, TurboCAD®, DesignCAD 3D Max, etc. In this regard, code 920 can take any now known or later developed file format. For example, code 920 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 920 may be translated between different formats, converted into a set of data signals and transmitted, received as a set of data signals and converted to code, stored, etc., as necessary. Code 920 may be an input to system 900 and may come from a part designer, an intellectual property (IP) provider, a design company, the operator or owner of system 900, or from other sources. In any event, AM control system 904 executes code 920, dividing blade 20 and/or shim 54 (FIGS. 2-12) into a series of thin slices that it assembles using AM printer 906 in successive layers of liquid, powder, sheet or other material. In the DMLM example, each layer is melted to the exact geometry defined by code 920 and fused to the preceding layer. Subsequently, the blade 20 and/or shim 52 (FIGS. 2-12) may be exposed to any variety of finishing processes, e.g., minor machining, sealing, polishing, assembly to other part of the igniter tip, etc.

FIG. 14 illustrates a simplified cross-sectional view of the shim placed in the tapered groove of the blade's dovetail 32 and the blade attached to the rotor or wheel, according to embodiments of the disclosure. The shim 52 is placed in tapered groove 33 (not shown for clarity) and the ends of the shim are bent over the rotor 34 (or wheel) to lock the shim in place. With both ends of the shim bent over (as shown), the shim is prevented from moving axially (i.e., left or right in FIG. 14) with respect to the wheel/rotor 34. The thinned region 74 facilitates the bending of this side of the shim, as a full thickness shim may experience cracking if bent ninety degrees. The blended region 45 of the rotor 34 is important to the bend-over design to keep the bend radius ratio correct for the shim 52 to reduce cold-working stress on the shim 52.

FIG. 15 illustrates a simplified cross-sectional view of the shim 52 placed in between the blade dovetail 32 and the rotor or wheel, according to embodiments of the disclosure. The shim 52 is placed in between the rotor/wheel 32 and the blade 34 and the ends of the shim are bent over the blade dovetail 32 to lock the shim in place. With both ends of the shim bent over (as shown), the shim is prevented from moving axially (i.e., left or right in FIG. 15) with respect to the blade. The blade dovetail has the radially lower and axially facing surfaces blended or radiused to reduce stress on the portions of the shim that are bent over. The blended regions 47 of the blade dovetail 34 is important to the bend-over design to keep the bend radius ratio correct for the shim 52 to reduce cold-working stress on the shim 52. It is to be understood that the shim 52 may also have one end bent radially upward (against the blade dovetail) and the axially opposing end bent radially downward/inward (against the rotor/wheel). In this variation the corresponding regions of the dovetail and wheel should be radiused or blended to prevent undesired stress on the bent portions of the shim ends.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., soldering, fastening, ultrasonic welding, bonding). In various embodiments, electronic components described as being "coupled" can be linked via conventional hard-wired and/or wireless means such that these electronic components can communicate data with one another.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine blade comprising:
- a blade having a first end and a second end opposite the first end;
- a tip at an outer radial portion of the blade; and
- a base at an inner radial portion of the blade, the base including a dovetail for complementing a corresponding dovetail slot in a turbine rotor, the dovetail having:
  - a body;
  - a plurality of projections extending from the body in opposing directions for complementing a plurality of recesses in the corresponding dovetail slot; and
  - a tapered groove extending through the body from the first end to the second end, the tapered groove having a flat section extending inwardly from one of the first end or the second end and a tapered profile extending from the flat section to the other of the first end or the second end; wherein the flat section has a constant depth, and wherein the tapered profile gradually transitions from a first depth to a second depth different from the first depth, the tapered groove being open at a bottom surface of the body and sized to engage a shim.

2. The turbine blade of claim 1, wherein the flat section is about 3% to about 20% of a length of the tapered groove.

3. The turbine blade of claim 2, wherein the constant depth of the flat section is less than the first depth.

4. The turbine blade of claim 1, wherein the dovetail further includes:
- a blended region having a radiused surface located on a radially inner portion and an axially facing surface of the dovetail.

5. The turbine blade of claim 4, wherein the blended region is located on an upstream end and a downstream end of the dovetail.

6. The turbine blade of claim 1, wherein one or more of the dovetail slot and the dovetail further includes:
- a blended region having a radiused surface located on a radially inner portion and an axially facing surface of the dovetail slot or the dovetail.

7. A shim for retaining a turbine blade, the shim comprising:
- a main body having an upper surface and a lower surface, a first end of the main body, and a second end of the main body, the first end generally opposing the second end;
- a thinned region extending from the first end of the main body, wherein the upper surface is continuous between the first end of the main body and the thinned region, and wherein the thinned region further comprises a thinned, lower surface, the thinned, lower surface being offset from the lower surface of the main body; and wherein a first thickness is measured between the upper surface and the thinned, lower surface of the thinned region; a second thickness is measured between the upper surface and the lower surface of the main body at the first end of the main body adjacent to the thinned region; and a third thickness is measured between the upper surface and the lower surface of the main body at the second end of the main body, the second thickness being greater than both the first thickness and the third thickness, the main body tapering in thickness from the first end of the main body to the second end of the main body; and wherein a tapered region connects the lower surface of the main body to the thinned, lower surface of the thinned region.

8. The shim of claim 7, wherein the thinned region has a length equal to about one-quarter of a length of the main body.

9. The shim of claim 7, wherein the thinned region has a length equal to about three-sixteenths of a length of the main body.

10. The shim of claim 7, wherein the thinned region has a length equal to about one-eighth of a length of the main body.

11. The shim of claim 7, wherein the thinned region has a length equal to about 10% to about 25% of a length of the main body.

12. A turbine rotor comprising:

a rotor body having a plurality of dovetail slots including a plurality of recesses;

a turbine blade within one of the plurality of dovetail slots, the turbine blade having:

a blade having a first end and a second end opposite the first end;

a tip at an outer radial portion of the blade; and a base at an inner radial portion of the blade, the base including a dovetail for complementing a corresponding dovetail slot in the turbine rotor, the dovetail having:

a body;

a plurality of projections extending from the body in opposing directions for complementing a plurality of recesses in the corresponding dovetail slot; and a tapered groove extending through the body from the first end to the second end, the tapered groove having a flat section extending inwardly from one of the first end or the second end and a tapered profile extending from the flat section to the other of the first end or the second end; wherein the flat section has a constant depth, wherein the tapered profile gradually transitions from a first depth to a second depth different from the first depth, the tapered groove being open at a bottom surface of the body and sized to engage a shim.

13. The turbine rotor of claim 12, wherein the flat section is about 3% to about 20% of a length of the tapered groove.

14. The turbine rotor of claim 13, wherein the constant depth of the flat section is less than the first depth.

15. The turbine rotor of claim 13, wherein the shim includes:

a main body having an upper surface and a lower surface, a first end of the main body, and a second end of the main body, the first end generally opposing the second end;

a thinned region extending from the first end of the main body, wherein the upper surface is continuous between the first end of the main body and the thinned region, and wherein the thinned region further comprises a thinned, lower surface, the thinned, lower surface being offset from the lower surface of the main body; and wherein a first thickness is measured between the upper surface and the thinned, lower surface of the thinned region; a second thickness is measured between the upper surface and the lower surface of the main body at the first end of the main body adjacent to the thinned region; and a third thickness is measured between the upper surface and the lower surface of the main body at the second end of the main body, the second thickness being greater than both the first thickness and the third thickness.

16. The turbine rotor of claim 15, wherein the thinned region has a length equal to about 10% to about 25% of a length of the main body.

17. The turbine rotor of claim 15, wherein at least one of the dovetail slot or the dovetail further includes:

a blended region having a radiused surface located on a radially inner portion and an axially facing surface of the dovetail slot or dovetail.

18. The turbine rotor of claim 17, wherein the blended region is located on an upstream end and a downstream end of the dovetail slot or dovetail.

19. The turbine blade of claim 12, wherein the dovetail further includes:

a blended region having a radiused surface located on a radially inner portion and an axially facing surface of the dovetail.

20. The turbine rotor of claim 12, further comprising the shim for retaining the turbine blade in the dovetail slot.

* * * * *